United States Patent [19]

Agey, III

[11] 4,346,798

[45] Aug. 31, 1982

[54] LIQUID DIVERTING COIN HOPPER

[76] Inventor: Davis M. Agey, III, 2054 Kingston Ave., Norfolk, Va. 23503

[21] Appl. No.: 129,775

[22] Filed: Mar. 12, 1980

[51] Int. Cl.[3] ..... G07F 1/04

[52] U.S. Cl. ..... 194/1 K; 194/97 R

[58] Field of Search ..... 194/1 K, 97 R; 232/7, 232/55; 193/DIG. 1

[56] References Cited

U.S. PATENT DOCUMENTS

| | | | |
|---|---|---|---|
| 1,563,146 | 11/1925 | Barnarn | 194/1 K |
| 2,190,212 | 2/1940 | MacDonald | 194/97 R X |
| 2,865,561 | 12/1958 | Rosapepe | 232/7 |
| 3,024,970 | 3/1962 | Powers | 232/7 X |
| 4,062,435 | 12/1977 | Chalabian | 194/1 R X |
| 4,230,213 | 10/1980 | Spring | 194/1 K |

*Primary Examiner*—F. J. Bartuska

*Attorney, Agent, or Firm*—Sughrue, Mion, Zinn, Macpeak and Seas

[57] ABSTRACT

A coin hopper for use on vending machines utilizes a transparent housing having openings at the top and bottom thereof for the passage of coins or liquids. A first downwardly slanted support surface is provided whereby coins or liquids entering the opening at the top of the hopper gravitate downwardly free falling at the end of the first support surface onto a second downwardly slanted countersunk perforated support surface. Liquid falling onto the second downwardly slanted perforated support surface passes through the countersunk perforations into a compartment located therebelow. Coins, on the other hand, gravitate downwardly along both downwardly slanted support surfaces free falling at the end thereof into a coin changer. A tube connected to an aperture in the bottom of the compartment drains liquid collected within said compartment. Use of the downwardly slanted countersunk support surface having a compartment therebelow prevents liquids which may enter the hopper from flowing downwardly into the coin changer causing malfunction thereof or causing dangerous electrical conditions to occur.

10 Claims, 4 Drawing Figures

LIQUID DIVERTING COIN HOPPER

BACKGROUND OF THE INVENTION

1. Field of the Invention

This invention pertains to a coin hopper for vending machines which utilizes downwardly slanted support surfaces for the gravitational passage of coins and liquid entering the hopper. One of the slanted surfaces is provided with countersunk perforations therein for diverting liquid which may enter the coin hopper through the coin slot of a vending machine from entering into the coin changer thus preventing hazardous electrical conditions from occurring and preventing malfunction of the coin changer.

2. Statement of the Prior Art

Prior developments in this field are shown, by way of general illustration, in the following list of patents:

| Patentee's Name | Pat. No. | Issue Date |
|---|---|---|
| A. W. Barnard | 1,563,146 | Nov. 24, 1925 |
| Chalabian | 4,062,435 | Dec. 13, 1977 |

SUMMARY OF THE INVENTION

This invention relates to a coin hopper for use on vending machines and has for one object thereof the provision of downwardly slanted support surfaces for the gravitational descent of coins or liquids entering the coin hopper through the coin slot thereof.

It is a further object of this invention to provide a coin hopper for vending machines which utilizes a plurality of downwardly slanted support surfaces whereby coins or liquids gravitate downwardly within the hopper. The coins entering the hopper descend along the downwardly slanted support surfaces and fall into a coin changer positioned therebelow.

It is another object of this invention to provide one of the downwardly slanted support surfaces with countersunk perforations for diverting liquids or the like from entering the coin changer.

It is a further object of this invention to provide a liquid holding compartment below the countersunk perforated downwardly slanted support surface for collecting liquid which may pass through the perforations.

It is yet another object of this invention to provide drainage means for said compartment for removing liquid collected within said compartment.

Other and further objects of this invention will become apparent to those skilled in the art to which this invention pertains from a consideration of the following specification when read in conjunction with the annexed drawings.

DESCRIPTION OF THE PREFERRED EMBODIMENT OF THE INVENTION

Figure 1:
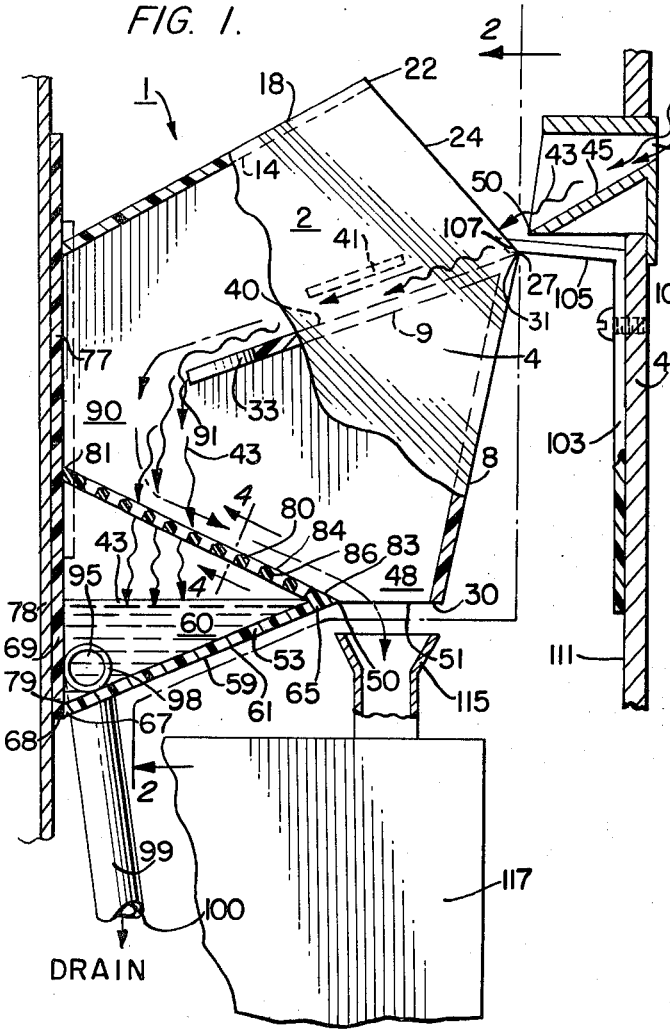
FIG. 1 is an elevated side view of a coin hopper showing coins and liquid gravitating downwardly along slanted support surfaces, the liquid passing through countersunk perforations into a compartment therebelow and the coins falling into the coin changer.
Figure 3:
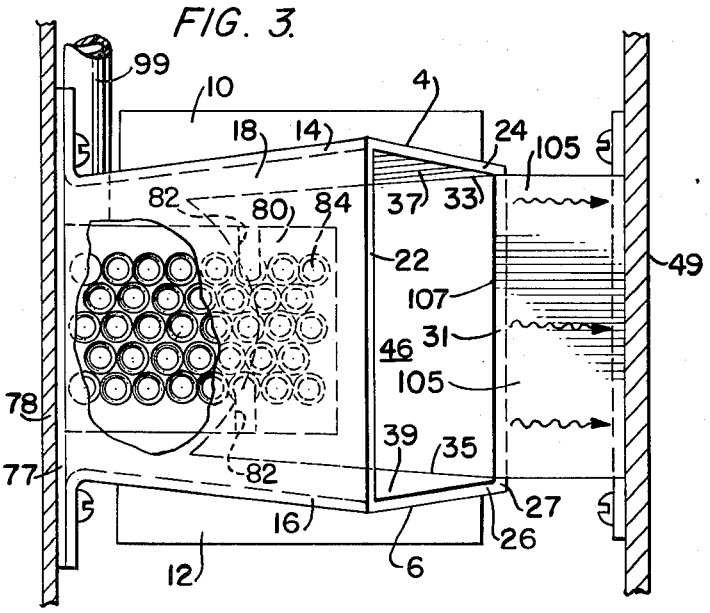
FIG. 3 is a plan view of the coin hopper attached to the inside of a vending machine.

Referring to FIGS. 1 and 3 of the drawings, the liquid diverting coin hopper 1 comprises a housing 2 having side walls 4 and 6, a front wall 8 which has an extension section 9, and flanges 10 and 12 integrally formed on a single sheet of rigid clear plastic material.

The side walls 4 and 6 have rearwardly downwardly extending slanted top edges 14 and 16 which support a top wall 18 having a front edge 22. Sides 4 and 6 have downwardly extending front side edges 24 and 26 which terminate at juncture edge 27. The front wall 8 slants downwardly and inwardly and terminates in a bottom edge 30. The extension 9 of the front wall 8 is turned inwardly at edge 27 between the side walls 4 and 6 forming a rounded lip 31. The side edges 33 and 35 of the extension section 9 are secured to the insides 37 and 39 of the side walls 4 and 6 such that the extension section 9 forms a first downwardly extending, slanted support surface 40 for the gravitational support of a coin 41 or liquid 43 which may enter chute 45 from coin slot 47 located in the front panel 49 of a vending machine.

The side walls 4 and 6 have horizontal bottom edges 51 (one shown) which lie in the same plain as the bottom edge 30 of wall 8. The bottom horizontal edges 51 terminate at juncture 50 and then continue downwardly forming bottom slanted edges 53 and 57, FIG. 2, to which is attached a bottom wall 59 having upper edge 65 and lower edge 67 the latter having an extension lip 68 thereon. The side walls 4 and 6 have rear bottom edges 69 (one shown) extending downwardly below the ends 73 and 75 of the flanges 10 and 12. A rear wall 77, FIG. 1, having a bottom edge 79 is secured to the flanges 10 and 12 and to the bottom edges 69 by suitable means with the bottom edge 79 resting on the extension lip 68 of the bottom wall 59. Said flanges 10 and 12 and said rear wall 77 secured to a panel 78 within the vending maching.

Thus constructed, the side walls 4 and 6, bottom wall 59 and rear wall 77 define a compartment 60 for collecting liquid 43 which may enter the hopper through coin slot 47.

Figure 4:
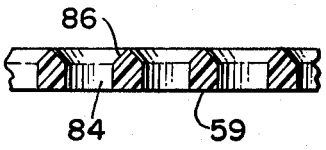
FIG. 4 is a front view of the countersunk perforated support surface taken along the line 4—4 of FIG. 1.

A second support surface 80, FIG. 1, slants downwardly and oppositely to that of the first slated surface 40, has an end 81 secured to rear wall 77 and an end 83 secured to the upper edge 65 of bottom wall 59. The sides of support surface 80 are secured to the inside of side walls 4 and 6. The second downwardly slanted surface 80 has a plurality of apertures 84 therein which will permit liquid 43 entering the coin hopper top opening 46 to pass therebetween thus falling into the compartment 60 therebelow. The apertures 84 having some of their peripheries substantially touching and are countersunk at 86, FIG. 4, and act to draw the liquid 43 in a syphen-like fashion into the compartment therebelow. Notches 82 are cut in the sides of support surface 80 and intersect the aperatures 84. Liquid is thus prevented from flowing down along the sides of this support surface into the coin changer therebelow. Bottom edge 30, horizontal edges 51 and end 83 of the perforated slanted surface 80 which is attached to upper edge 65 of bottom wall 59 define an opening 48 in the bottom of the hopper through which a coin passes falling over the end 83 into a coin chute 115 descending into a coin changer 117.

Figure 2:
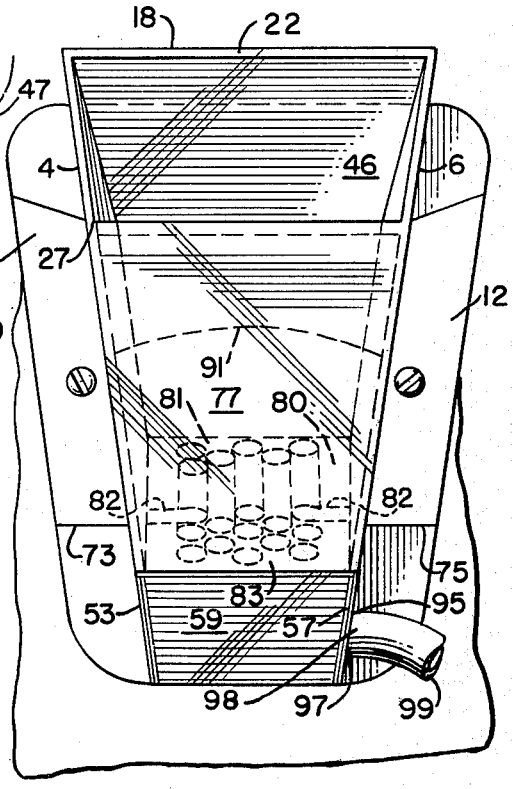
FIG. 2 is an end view of the coin hopper taken along the line 2—2 of FIG. 1.

An aperture 95, FIGS. 1–2, is provided in one of the side walls of the hopper at the bottom section 97 thereof, has one end 98 of a flexible tube 99 tightly secured therein by suitable means. The opposite end 100 of the flexible tube 99 is secured to the vending machine such that liquid 43 collected within compartment 60 will drain to the outside thereof.

A plate 103, FIG. 2, has an upwardly projecting surface 105 having a bevelled lip 107. The bevelled lip 107 lies adjacent to and overhangs the rounded lip 31 of front wall 8. The plate 103 is secured to the inside wall 111 of front panel 49 of a vending machine by any suitable means. The bevelled lip 107 overhangs the rounded lip 31 such that liquid 43 which may enter coin slot 47 in a trickle-like fashion will descend along chute 45 dripping over edge 50 onto the lip 107 and subsequently flow downwardly along surface 105 where it will travel travel downwardly between the plate 103 and the inside wall 111 of the front panel 49 of a vending machine away from the entrance 115 of the coin changer 117.

In operation, when a coin 41 having a diameter greater than the diameter of the apertures 84 of the second downwardly slanted support surface enters the slot 49 it will slide downwardly along the chute 45 and enter the opening 46 of the coin hopper housing 2. The coin will travel downwardly along the slanted surface 40 dropping over the semi-circular end 91 of said surface free falling downwardly through opening 90 onto the downwardly slanted perforated surface 86 descending downwardly therealong until it drops through opening 48 at the bottom of the hopper falling into the chute 115 of coin changer 117.

In the event that liquid 43 may enter the coin slot 47 under pressure, the liquid will travel downwardly over the first slanted surface 40 falling through the opening 90 and onto the perforated downwardly slanted surface 80 whereby it will pass through the countersunk perforations 84 falling into the compartment 60 therebelow. The liquid will be drained away through the aperture 95 and the flexible tube 98. Should the liquid not have sufficient force or pressure to enter the upper housing opening 46, it will be caught by the lip 107 and flow downwardly along surface 105 draining between the plate 103 and the inside wall 111 of the vending machine front panel 49 away from the entrance 115 of the coin changer 117.

Thus constructed, the liquid which may enter the coin hopper is diverted from falling through the opening 48 at the bottom of the hopper housing 2. By using countersunk perforations in surface 80 and compartment therebelow, the liquid is prevented from entering into the coin changer located below the hopper thus avoiding dangerous electrical conditions from occurring within the coin changer which could result in possible personal injury, destruction and malfunction of both the vending machine and coin changer.

Liquid forced into the vending machine through the coin slot and entering the coin changer thereof has, in the past, created malfunction of the coin changer, caused serious hazardous conditions to prevail resulting in destruction of the vending machine. With the installation of this liquid diverting coin hopper to existing vending machines, liquid is prevented from entering the coin changer thus preventing the above enumerated hazardous conditions and malfunctions from occurring.

While the invention has been shown and described with respect to a preferred embodiment thereof, it will be understood by those skilled in the art to which this invention pertains that the foregoing description may be changed in form and detail without departing from the spirit and scope of the invention.

What I claim is:

1. A liquid diverting coin hopper for vending machines comprising;
   - a housing having side walls, front and rear walls and top and bottom walls, said front wall having a rounded lip at one end thereof;
   - a first downwardly extending support surface between said side walls, said first downwardly extending support surface terminating in a semi-circular edge a distance from said rear wall;
   - a second downwardly extending support surface below the first support surface within the housing;
   - said second downwardly extending support surface having a plurality of perforations therein for the passage of liquid therethrough;
   - said side walls, rear wall and bottom wall defining a compartment for liquid within the housing;
   - drainage means within said compartment; and
   - a plate having an upwardly extending surface the end of which has a bevelled lip thereon, said plate attached to the inside panel of a vending machine and said bevelled lip resting on said rounded lip of said front wall.

2. A liquid diverting coin hopper for vending machines as defined in claim 1, wherein:
   - said perforations are countersunk.

3. A liquid diverting coin hopper for vending machines as defined in claim 1, wherein:
   - said coin hopper having an opening at the top front thereof for the passage of coins or liquid therethrough, an opening at the bottom thereof for the passage of coins into a coin changer therebelow, and means between said openings for diverting liquid away from said bottom opening.

4. A liquid diverting coin hopper for vending machines as defined in claim 1, and:
   - said first and second downwardly extending support surfaces spaced one above the other and slanting downwardly in opposite directions.

5. A liquid diverting coin hopper for vending machines as defined in claim 1, wherein:
   - said hopper is constructed from clear rigid plastic material, said first and second downwardly extending support surfaces being secured to the inside of the said side walls, and said first downwardly extending support surface having a semi-circular end.

6. A liquid diverting coin hopper as defined in claim 1, wherein:
   - said second support surface is notched along the sides thereof and said notches intersect said apertures.

7. A liquid diverting coin hopper for vending machines comprising:
   - a housing having side walls, top and bottom walls, and front and rear walls, said housing having an opening in the top and bottom thereof;
   - said side walls having rearwardly downwardly slanting top edges, forwardly downwardly slanting front edges, horizontal bottom edges and downwardly slanting bottom edges extending from said horizontal bottom edges;

said top wall secured to said slanted top edges, and said bottom wall secured to said bottom slanted edges;

flange means integral with said side walls, said rear wall secured to said flange means, and said flange means and said rear wall secured to a panel within said vending machine;

a first downwardly extending support surface within said housing;

a second downwardly extending support surface within said housing below said first support surface;

said first downwardly extending support surface having a semi-circular edge located a distance from said rear wall, the space between said semi-circular edge and said rear wall defining an opening through which coins and liquid may pass;

said second downwardly extending support surface below said first downwardly extending support surface slanting downwardly in opposite directions from each other;

perforations in said second downwardly extending support surface for the passage of liquid therethrough;

said perforations having a diameter less than the diameter of said coins;

said perforations countersunk acting to draw liquid therethrough in a syphen-like fashion;

a compartment below said perforated support surface;

drainage means for said compartment;

plate means secured to the inside surface of a front panel of a vending machine, said plate means having an upwardly extending support surface the end of which lies adjacent said rounded edge of said front wall;

said first and second downwardly extending support surfaces gravitationally supporting coins and liquid such that said coins descend through the bottom opening falling into a coin changer below said hopper and said liquid diverted through said countersunk perforations into said compartment, said perforations acting to prevent said liquid from entering said bottom opening and falling into said coin changer causing malfunction thereof.

8. A liquid diverting coin hopper for vending machines as defined in claim 7, wherein:

said side walls, flange, front wall and first downwardly extending support surface integrally constructed from a rigid sheet of clear plastic material.

9. A liquid diverting coin hopper as defined in claim 7, wherein:

said downwardly extending perforated support surface secured to said rear wall, bottom wall and side walls, and said side walls, rear wall and bottom wall defining a compartment within said housing below said downwardly extending perforated support surface for the collection of liquid falling through said perforations.

10. A liquid diverting coin hopper for vending machines comprising:

a hopper having openings in the top and bottom thereof;

a front wall having an extension section;

said extension section forming a first downwardly extending support surface within said hopper;

a second downwardly extending support surface below said first downwardly extending support surface, said second downwardly extending support surface slanting in the opposite direction from the first support surface;

said second downwardly extending support surface having a plurality of countersunk perforations on its surface and slots adjacent the edges of said second support surface, the peripheries of said perforations and said slots are substantially in contact with each other so as to present a substantially continuous barrier to the passage of liquid longitudinally of said second support surface, for the passage of liquid therethrough;

a compartment below said countersunk-perforations, said compartment for collecting liquid passing though said perforations; and drainage means within said compartment for draining said liquid from within said compartment to the outside of said vending machine.

* * * * *